US007087851B2

(12) United States Patent
Mayer

(10) Patent No.: US 7,087,851 B2
(45) Date of Patent: Aug. 8, 2006

(54) MICROSWITCH

(75) Inventor: Wolfgang Mayer, Haar (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 11/179,839

(22) Filed: Jul. 11, 2005

(65) Prior Publication Data

US 2006/0016678 A1 Jan. 26, 2006

(30) Foreign Application Priority Data

Jul. 21, 2004 (DE) ..... 10 2004 035 193

(51) Int. Cl.
*H01H 5/18* (2006.01)

(52) U.S. Cl. ..... 200/461; 200/405

(58) Field of Classification Search ..... 200/405–409, 200/440, 442, 449, 453, 459–461, 520
See application file for complete search history.

(56) References Cited

U.S. PATENT DOCUMENTS 3,187,132 A * 6/1965 Dennison ..... 200/461
4,931,605 A * 6/1990 Zoller ..... 200/408
6,255,611 B1 7/2001 Chou

FOREIGN PATENT DOCUMENTS

EP 0618601 A1 10/1994
EP 0618603 A1 10/1994
FR 2716746 A1 9/1995

* cited by examiner

*Primary Examiner*—Michael Friedhofer
*Assistant Examiner*—Lisa Klaus
(74) *Attorney, Agent, or Firm*—Townsend and Townsend and Crew

(57) ABSTRACT

The invention relates to a microswitch comprising a housing, a switching plunger arranged in displaced relationship with the center of said housing and projecting from said housing, contacts which are arranged on the housing side located opposite the switching plunger, and a contact bridge which is adapted to be transferred from a first to a second switching position through the switching plunger and a bistable spring, said switching plunger being provided with a cantilevered arm which projects on one side and on the projecting end of which a downholder is provided for positive opening of the contact bridge. In order to improve a microswitch of the type mentioned at the beginning in such a way that its overall size can be reduced still further and that a reliable positive opening operation will take place, the present invention is so conceived that, on the switching plunger side located opposite the cantilevered arm, a support projection is arranged, which acts on a resilient part of the spring in spaced relationship with the switching plunger, in such a way that, when the switching plunger is pressed down, a moment (M) will be applied via the support projection to the cantilevered arm of the switching plunger in the opening direction of the contact bridge.

6 Claims, 4 Drawing Sheets

MICROSWITCH

The invention relates to a microswitch comprising a housing, a switching plunger arranged in displaced relationship with the centre of said housing and projecting from said housing, contacts which are arranged on the housing side located opposite the switching plunger, and a contact bridge which is adapted to be transferred from a first to a second switching position through the switching plunger and a bistable spring, said switching plunger being provided with a cantilevered arm which projects on one side and on the projecting end of which a downholder is provided for positive opening of the contact bridge.

Such a microswitch is known e.g. from EP-618603 B1 which is owned by the applicant of the present patent application. In the known microswitch, a bistable spring assembly is provided, which has the effect that the switch contacts are opened rapidly so as to reduce the loss of contact material caused due to flashover during the switching operation. Since it can nevertheless not be fully excluded that fusing of the switch contacts may occur due to excessively high currents or due to oxidation, the known microswitch is so conceived that the cantilevered arm has provided thereon a downholder which, during the continued movement of the switching plunger, acts on the contact bridge and leads to positive opening of the contacts. In microswitches having an extremely small structural design, the problem arises that the cantilevered arm may yield due to its dimensioning. In order to achieve a reliable positive opening operation, it would therefore be necessary to increase the distance covered by the plunger, or the cantilevered arm would have to be provided with stronger dimensions. Both measures would have a negative influence on the overall size of the microswitch. The possibility of producing the switching plunger with a cantilevered arm which consists of a material having a higher modulus of elasticity results in an increase in costs.

It is therefore the object of the present invention to improve a microswitch of the type mentioned at the beginning in such a way that the overall size can be reduced still further and that a reliable positive opening operation will take place.

According to the present invention, this object is achieved in that, on the switching plunger side located opposite the cantilevered arm, a support projection is arranged, which acts on a resilient part of the spring in spaced relationship with the switching plunger, in such a way that, when the switching plunger is pressed down, a moment will be applied via the support projection to the cantilevered arm of the switching plunger in the opening direction of the contact bridge.

By means of the solution according to the present invention it is achieved that the downholder of the cantilevered arm is moved downwards not only in accordance with the distance covered by the plunger, but that, due to the support on the side located opposite the cantilevered arm, a rotary motion will additionally act on the cantilevered arm so that a flex-ion of the cantilevered arm will be compensated by the torque acting on said cantilevered arm. Hence, this solution allows a maintenance of the original distance covered by the plunger and does not necessitate stronger dimensions of the said cantilevered arm, let alone the use of expensive materials.

According to an advantageous embodiment, the area of the spring acted upon by the support projection has a higher spring constant than the contact bridge at the point where the downholder of the cantilevered arm presses onto said contact bridge.

According to a further development of the present invention, the switching plunger has two axially effective guide means, the cantilevered arm and the support projection being located between these two guide means, and said two guide means being arranged such that they are displaced relative to one another transversely to the axial direction of the plunger. In this way, the opening moment acting on the lever arm of the cantilevered arm is extended, and this leads to a further improvement in the positive opening operation.

According to a preferred embodiment, the lateral distance between the lower guide means and the axis of the plunger is the same as that between the support projection and the axis of the plunger.

According to another preferred embodiment, the lower guide means comprises two laterally arranged guide ribs which are guided in complementary grooves provided in the housing wall.

According to a specially preferred embodiment, the cantilevered arm, the support projection as well as the lateral guide ribs are integrally connected to the switching plunger.

In the following, one embodiment of the present invention will be explained in detail making reference to a drawing, in which.

Figure 1:
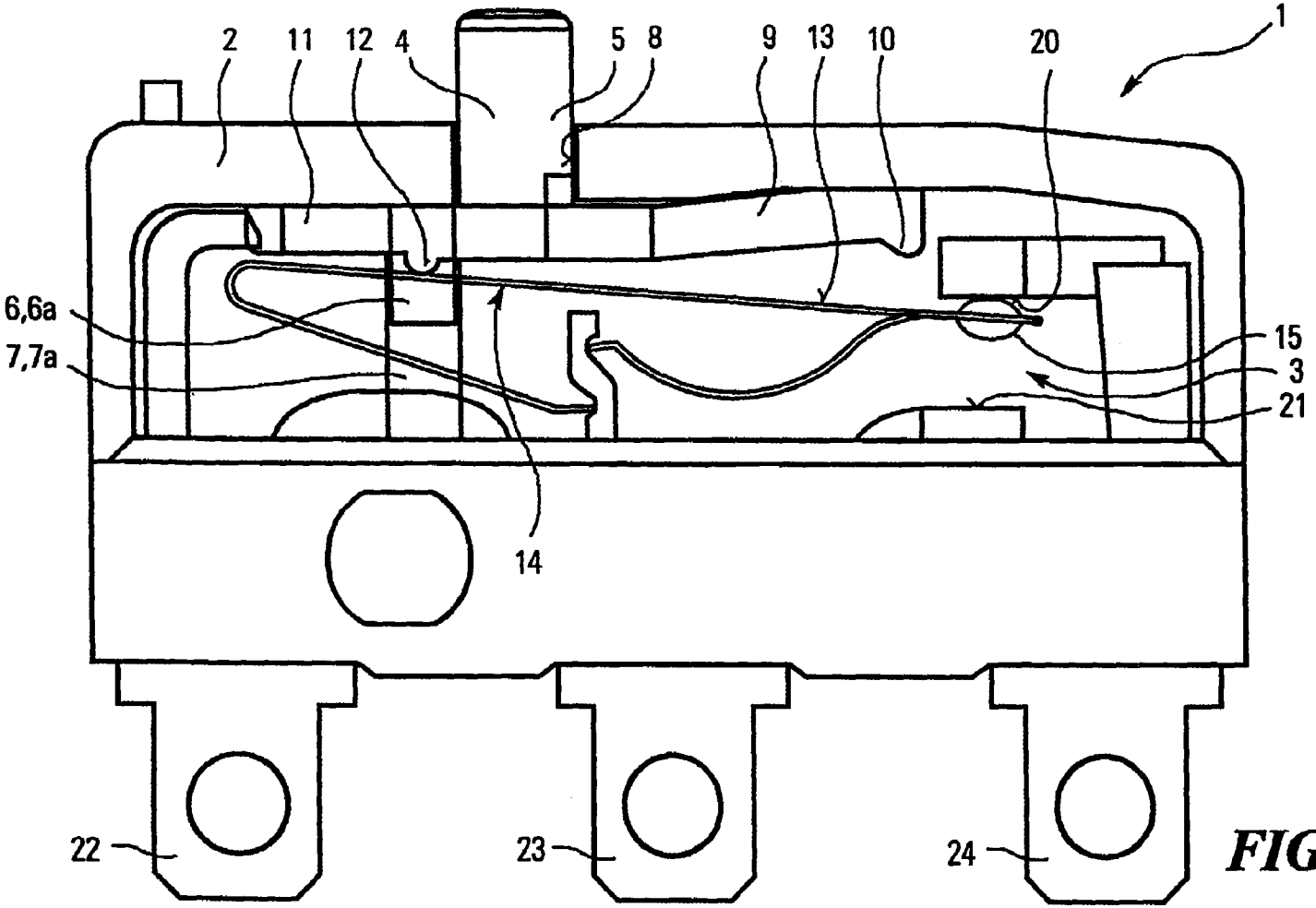
FIG. 1 shows a side view of the microswitch in its starting position.

The drawing shows a microswitch in a sectional view, said microswitch comprising a housing 2 with a housing interior 3. The housing 2 has arranged therein a switching plunger 4 provided with two axial guide means 5 and 6 received in two bearing locations 7 and 8 in the housing 2. The guide means 6 disposed in the housing interior is provided with two guide ribs 6*a*, which are arranged laterally on the switching plunger and which, at the associated bearing location 7, engage two guide grooves 7*a* provided in the inner wall of the housing. The guide means 5, which is located opposite the guide means 6, and the bearing location 8 associated therewith have an oval cross-section. Furthermore, the free end of the switching plunger 4 has attached thereto a downholder 10 via a cantilevered arm. On the switching plunger side located opposite the cantilevered arm 9 an extension is arranged, which is provided with a support projection 12. The extension 11 of the switching plunger 4 acts via the support projection 12 on an end of an elastically deformable and electrically conductive contact bridge 13 that is provided with a bistable spring assembly comprising a pressure spring member 14 and a switch contact 15, said contact bridge end being bent into the shape of a clasp. The pressure spring member 14 and the contact bridge 13 are implemented as a one-piece component and rest on both sides on bulges 17 and 18 of an S-shaped fixed contact 19, the contact bridge 13 being held in position and being connected to the fixed contact 19 in an electrically conductive manner. In the engagement area of the switch contact 15, two fixed contacts 20 and 21 are arranged, which, like the fixed contact 19, are connected in an electrically conductive manner to connecting contacts 22, 23 and 24 arranged on the outer surface of the housing 2. In addition, reinforcements 25 are provided on the straight portions of the clasp-shaped contact bridge 13.

Figure 2:
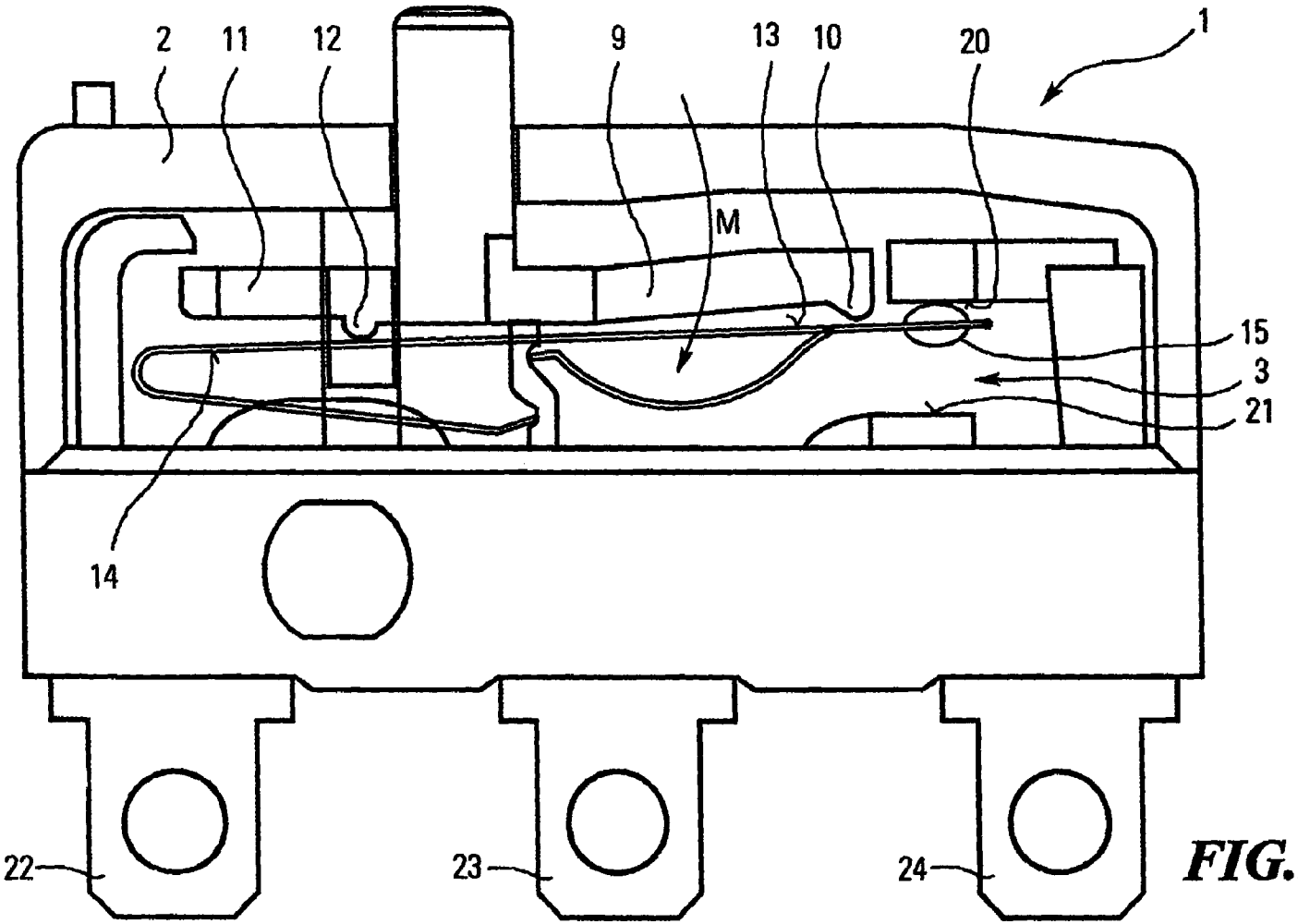
FIG. 2 shows a sectional view of the microswitch at the switching point.
Figure 3:
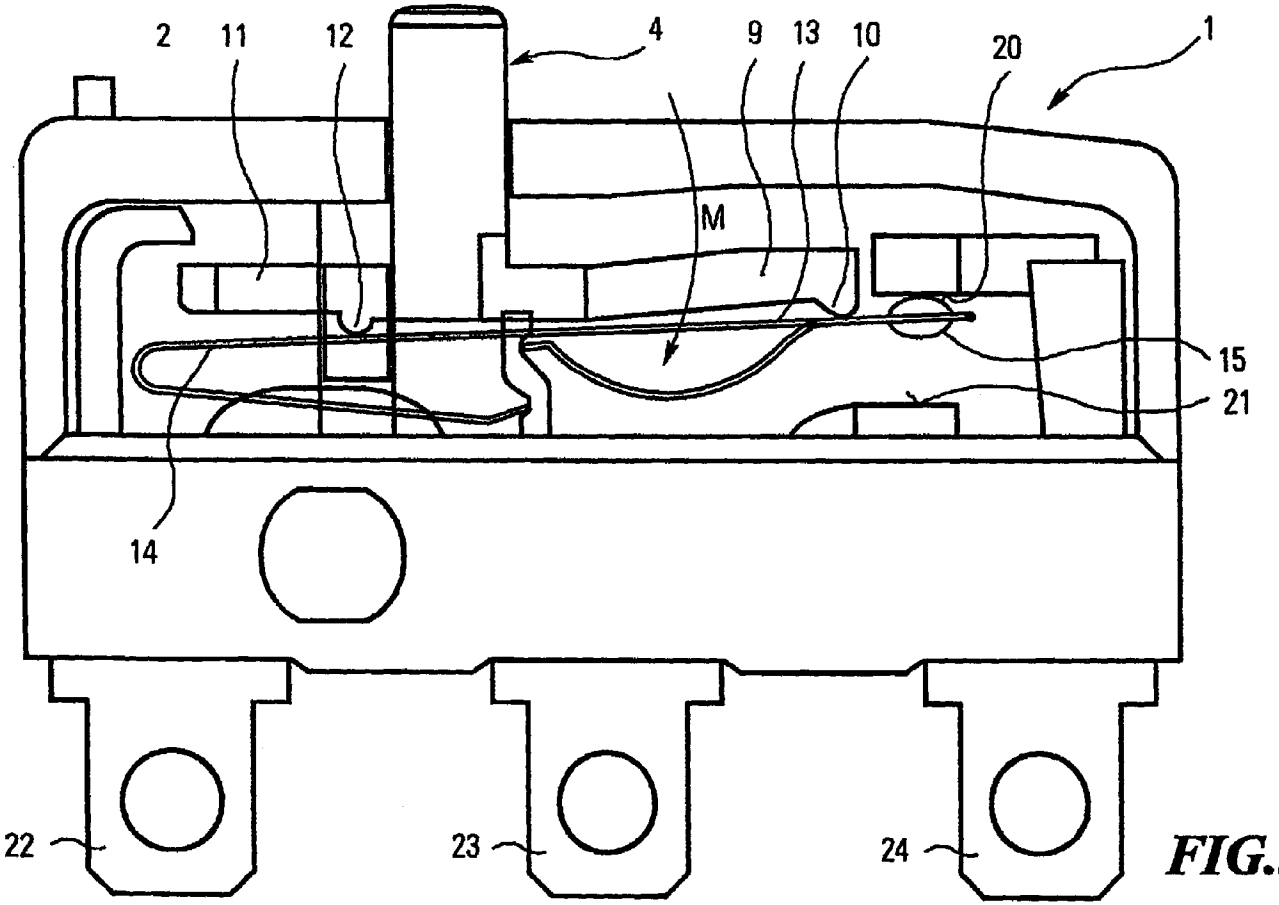
FIG. 3 shows a sectional view of the microswitch at the beginning of the positive opening operation.

In the following, the mode of operation of the microswitch will be explained in detail. At the starting position (FIG. 1), the pressure spring 14 causes the switch contact 15 to be held in the first switching position, supported by the force of the resilient contact bridge 13. In this condition, the connecting contact 22 is connected to the connecting contact 24 via the fixed contact 19, via the contact bridge 13, via the switch contact 15, and via the fixed contact 20. When the switching plunger 4 is pressed into the housing due to the application of an external force, the extension 11 will act via the support projection 12 onto the bent end of the resilient contact bridge 13, which will, consequently, undergo elastic deformation. In the course of this process, the switching plunger 4 is guided by its two axial guide means 5 and 6 in the associated bearings 7 and 7*a*, respectively, as well as 8. Due to the shape of the guide means 5 and 6 and of the bearings 7 and 8 associated therewith, the switching plunger 4 is supported such that it is secured against rotation about its axis, but can be displaced in the axial direction. When the switching plunger 4 continues its movement into the housing (FIG. 2), the line of action of the pressure spring 14 inclines until the line of action of the pressure spring 14 comes to lie, in the switching position, in the surface defined by the contact line between the contact bridge 13 and the support projection 12 and the connection line between the transition of the pressure spring 14 and the contact bridge 13. If the contact between the switch contact 15 and the fixed contact 20 is not fused, but can be separated freely, the contact will immediately be switched over with high speed as soon as the switching plunger 4 is moved into the housing 2 beyond the switching point. If the contact between the fixed contact 20 and the switch contact 15 should, however, be fused and prevent switching over, the downholder 10 will come into engagement with the contact bridge 13 a short time after the switching plunger 4 has been moved beyond the switching point. Due to the fact that the plunger 4 rests, on the side located opposite the cantilevered arm 9, via the support projection arranged on the extension 11 on the bent end of the spring 14, a moment will act on the switching plunger in the direction of the arrow M, i.e. in the opening direction of the contact bridge. This moment M has the effect that the downholder 10 is pressed down further than would, in principle, be intended by the displacement path of the plunger. The total amount of play between the switching plunger and the guide means causes the downholder to be lowered still further. In this way, a yield of the cantilevered arm caused by bending can be compensated for more effectively, without any necessity of increasing the distance covered by the plunger.

Figure 4:
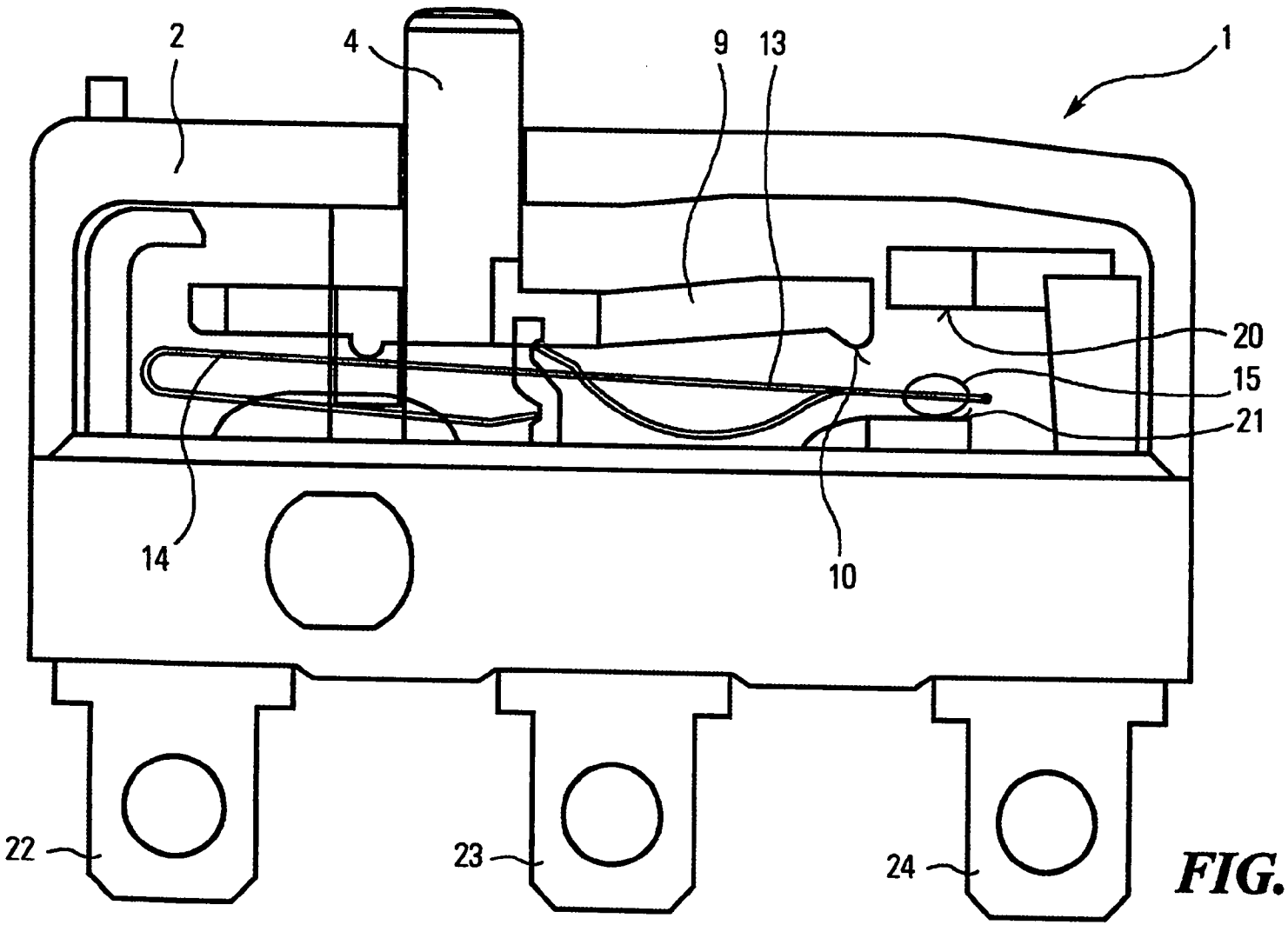
FIG. 4 shows a sectional view of the microswitch, the switching plunger occupying its final position.

In order to guarantee that the fused parts will be separated, the switching plunger can be pressed into the housing until the downholder presses the contact bridge 13 directly onto the fixed contact (cf. FIG. 4).

The invention claimed is:

1. A microswitch (1) comprising a housing (2), a switching plunger (4) arranged in displaced relationship with the centre of said housing (2) and projecting from said housing, contacts (22, 23, 24) arranged on the housing side located opposite the switching plunger, and a contact bridge (13) which is adapted to be transferred from a first to a second switching position through the switching plunger (4) and a bistable spring (14), said switching plunger (4) being provided with a cantilevered arm (9) which projects on one side and on the projecting end of which a downholder (10) is provided for positive opening of the contact bridge (13), characterized in that on the switching plunger side located opposite the cantilevered arm (9), a support projection is arranged, which acts on a resilient part of the spring (14) in spaced relationship with the switching plunger (4), in such a way that, when the switching plunger (4) is pressed down, a moment (M) will be applied via the support projection (12) to the cantilevered arm (9) of the switching plunger (4) in the opening direction of the contact bridge (13).

2. A microswitch according to claim 1, characterized in that the spring (14) acted upon by the support projection (12) of the switching plunger (4) has a higher spring constant than the contact bridge (13) acted upon by the downholder (10) of the cantilevered arm (9).

3. A microswitch according to claim 1, characterized in that the switching plunger (4) has axially effective guide means (5, 6), the cantilevered arm (9) and the support projection (12) being located between these two guide means, and said two guide means being arranged such that they are displaced relative to one another transversely to the axial direction of the plunger (4).

4. A microswitch according to one of the claims 1, characterized in that the lateral distance between the lower guide means (6) and the axis of the plunger (4) is the same as that between the support projection (12) and the axis of the plunger (4).

5. A microswitch according to one of the claims 1, characterized in that the lower guide means (6) is provided with two guide ribs (6*a*), which are arranged laterally on the plunger (4) and which engage complementary guide grooves (7*a*) of the housing (2).

6. A microswitch according to one of the claims 1, characterized in that the cantilevered arm (9) and the support projection (12) as well as the guide ribs (6*a*) are integrally connected to the switching plunger.

* * * * *